US010105583B2

(12) United States Patent
Deveaux et al.

(10) Patent No.: US 10,105,583 B2
(45) Date of Patent: Oct. 23, 2018

(54) INTERACTIVE PROJECTILE-GAMING SYSTEM

(71) Applicants: Joy Deveaux, Arlington, VA (US); Rebecca Deveaux, Arlington, VA (US)

(72) Inventors: Joy Deveaux, Arlington, VA (US); Rebecca Deveaux, Arlington, VA (US)

( * ) Notice: Subject to any disclaimer, the term of this patent is extended or adjusted under 35 U.S.C. 154(b) by 349 days.

(21) Appl. No.: 14/955,555

(22) Filed: Dec. 1, 2015

(65) Prior Publication Data

US 2017/0151482 A1 Jun. 1, 2017

(51) Int. Cl.

| | |
|---|---|
| ***F41J 5/00*** | (2006.01) |
| ***A63F 9/02*** | (2006.01) |
| ***A63B 71/06*** | (2006.01) |
| ***A63B 67/06*** | (2006.01) |
| ***F41J 5/04*** | (2006.01) |
| ***A63H 33/18*** | (2006.01) |
| ***F41J 3/00*** | (2006.01) |

(52) U.S. Cl.

CPC ..... *A63B 71/0622* (2013.01); *A63B 67/06* (2013.01); *A63B 71/06* (2013.01); *A63F 9/02* (2013.01); *A63F 9/0204* (2013.01); *A63H 33/18* (2013.01); *F41J 3/00* (2013.01); *F41J 5/00* (2013.01); *F41J 5/04* (2013.01)

(58) Field of Classification Search

CPC ..... A63H 33/009; A63H 33/18; A63F 9/02; A63F 9/0204; F41J 3/00; F41J 5/00; F41J 5/04

See application file for complete search history.

(56) References Cited

U.S. PATENT DOCUMENTS

| | | | | | |
|---|---|---|---|---|---|
| 1,442,054 | A * | 1/1923 | Dixon | A63F 9/0204 | 273/397 |
| 3,643,950 | A * | 2/1972 | Holk | A63F 9/0204 | 273/394 |
| 4,545,583 | A * | 10/1985 | Pearman | F41G 3/2655 | 434/22 |
| 4,659,090 | A | 4/1987 | Kustanovich | | |
| 5,024,447 | A * | 6/1991 | Jude | F42B 12/385 | 342/386 |
| 5,123,656 | A * | 6/1992 | Green | A63B 67/06 | 273/400 |
| D341,381 | S * | 11/1993 | Niebling | D21/303 | |
| 5,573,239 | A | 11/1996 | Ryker et al. | | |
| 5,658,211 | A | 8/1997 | Glover | | |
| 6,155,936 | A | 12/2000 | Dorr | | |
| 6,761,117 | B1 * | 7/2004 | Benz | F42B 12/365 | 102/482 |
| 7,611,427 | B1 | 11/2009 | Cline | | |

(Continued)

*Primary Examiner* — Steven J Hylinski

(74) *Attorney, Agent, or Firm* — Global Intellectual Property Agency, LLC; Jordan Sworen

(57) ABSTRACT

A projectile throwing game. The present system is a game that involves throwing a projectile into the interior of a receiving unit. The receiving unit is equipped with a sensor that detects when a projectile enters the receiving unit. The receiving unit additionally has a transceiver configured to relay information to a processor unit. The processor unit is connected to a visual output and displays virtual images representing the physical receiver units. The object of the game is to throw specific projectiles into specific receiver units, as instructed by the virtual images.

20 Claims, 4 Drawing Sheets

(56) References Cited

U.S. PATENT DOCUMENTS

| | | | | |
|---|---|---|---|---|
| 8,523,185 | B1 * | 9/2013 | Gilbreath | F41J 5/056 273/348 |
| 9,364,732 | B2 * | 6/2016 | Endreszl | A63B 63/00 |
| 9,795,868 | B2 * | 10/2017 | Miller | A63F 7/0023 |
| 2003/0060288 | A1 * | 3/2003 | Oakes | F42B 5/025 463/51 |
| 2007/0070034 | A1 * | 3/2007 | Fanning | H04L 67/38 345/156 |
| 2015/0038048 | A1 * | 2/2015 | Rosenberg | F41A 33/00 446/429 |

* cited by examiner

INTERACTIVE PROJECTILE-GAMING SYSTEM

BACKGROUND OF THE INVENTION

The present invention relates to games involving projectiles, in particular to games involving projectiles and projectile receptacles that are connected to a display output. Games have long been used to pass time and stimulate thinking while honing certain physical or cognitive skills. More recently, games have been designed and used by many child therapists to help establish comfort and trust, to provide a window into a child's experiences, and to serve as a tool for skill building. One such set of skills is quick decision making and hand-eye coordination. Some games incorporate exercise and an augmented reality or an enhanced gaming experience, while others require a user to master fine and gross motor movements. Many such games are either completely virtual through a gaming system, lacking any physical aspect, or entirely physical, limiting the amount of customization able to be applied for each individual user.

Therefore, there exists a need in the prior art for a gaming system that uses physical projectiles and projectile receiving units in conjunction with a virtual gaming system that is configured to require projectiles be thrown into certain receiving units and able to adapt to each individual user. Moreover, there exists a need for a gaming system that uses an advanced sensor capable of distinguishing between individual projectiles in order to require specific projectile to be thrown at specific receiving units.

SUMMARY OF THE INVENTION

In view of the foregoing disadvantages inherent in the known types of projectile gaming systems now present in the prior art, the present invention provides an interactive projectile gaming system wherein the same can be utilized for providing convenience for the user when engaging in an interactive gaming activity involving throwing projectiles within a digitally integrated game. The present system comprises a projectile receiving unit having a housing, an aperture on the housing, an interior of the housing adapted to admit projectiles and a sensor designed to detect when a projectile enters the receiving unit. The system further comprises a logic and a projectile equipped with a transceiver. The logic is configured to connect to a visual output device and output virtual images representing the physical receiver units. The object of the game is to throw specific projectiles into specific receiver units, as instructed by the virtual images.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1B:
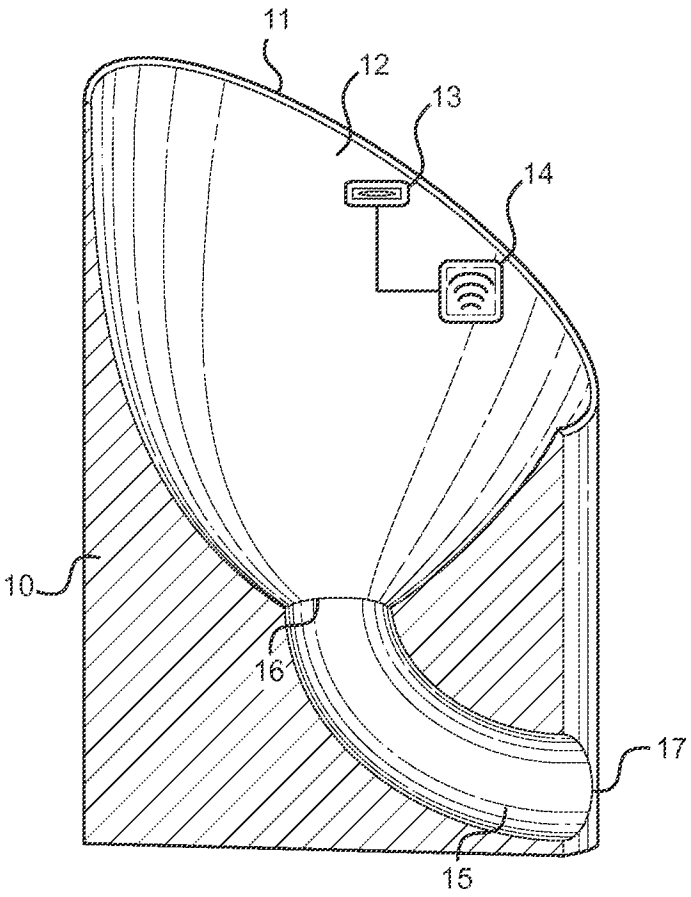
FIG. 1B shows a cutaway view of an embodiment of the projectile receptacle of the invention.

Reference is made herein to the attached drawings. Like reference numerals are used throughout the drawings to depict like or similar elements of the interactive projectile gaming system. The figures are intended for representative purposes only and should not be considered to be limiting in any respect.

As used herein, "logic" refers to (i) logic implemented as computer instructions and/or data within one or more computer processes and/or (ii) logic implemented in electronic circuitry. According to some embodiments, the operations, techniques, and/or components described herein can be implemented as (i) a special-purpose computing device having specialized hardware and a logic hardwired into the computing device to persistently perform the disclosed operations and/or techniques or (ii) a logic that is implementable on an electronic device having a general purpose hardware processor to execute the logic and a computer-readable medium, e.g. a memory, wherein implementation of the logic by the processor on the electronic device provides the electronic device with the function of a special-purpose computing device.

Figure 1A:
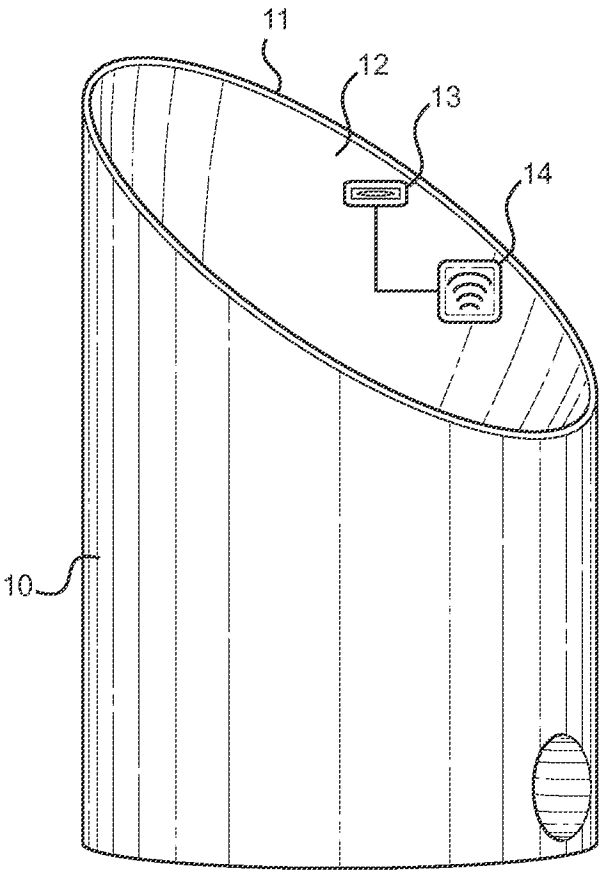
FIG. 1A shows a perspective view of an embodiment of the projectile receptacle of the invention.
Figure 2:
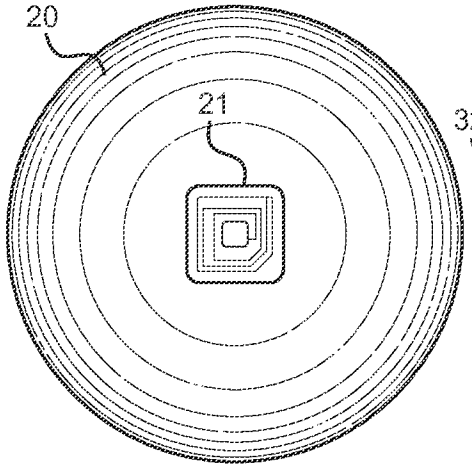
FIG. 2 shows a perspective view of a projectile of the present invention.

Referring now to FIGS. 1A, 1B and 2 there is shown an embodiment of the receiver unit of the invention. The receiver unit comprises a housing 10 with an interior 12 and an aperture 11 adapted to receive a projectile 20. The receiver unit further comprises a sensor 13 and a transceiver 14. The receiver unit is in communication with a logic via the transceiver 14. When the sensor 13 detects a projectile 20 entering the interior 12, the sensor conveys a signal to the transceiver 14, which in turn conveys to the logic that a projectile 20 has entered the interior 12.

In one embodiment of the invention, the sensor 13 is an optical sensor. In another embodiment of the invention, the sensor 13 is a radio frequency identification sensor. The projectile 20 that is used in this embodiment contains a radio frequency identification tag 21 that contains a unique identifier, such as a serial number, for that particular projectile 20. When the projectile 20 enters the interior 12 of the housing 10 through the aperture 11, the sensor 13 detects which projectile 20 has entered based on the radio identification tag 21, and relays that information to the transceiver 14.

In one embodiment of the invention, when the projectile 20 lands in the interior 12 of the receiving unit, it rests on the bottom of the interior 12. In another embodiment, there is a channel 15 inside the housing 10, the channel 15 having an a first opening 16 in communication with the interior 12 and a second opening 17 disposed on an exterior of the housing 10. When a projectile 20 enters the interior 12, the sensor 13 detects the projectile 20, relays that information to the transceiver 14, and the projectile 20 is then ejected out of the receiving unit via the channel 15. In yet an additional embodiment of the invention, there are multiple channels 15 inside the housing with separate openings on the exterior of the housing 10, and a projectile can be ejected in several possible directions.

In an alternative embodiment of the invention, the aperture 11 of the receiving unit is disposed on the housing 10 at an inclined angle. This allows for a first side of the interior 12 to be exposed above the opposite second side, and thus allow the first side to act as a backboard to assist in deflecting the projectiles into the interior 12.

Figure 3:
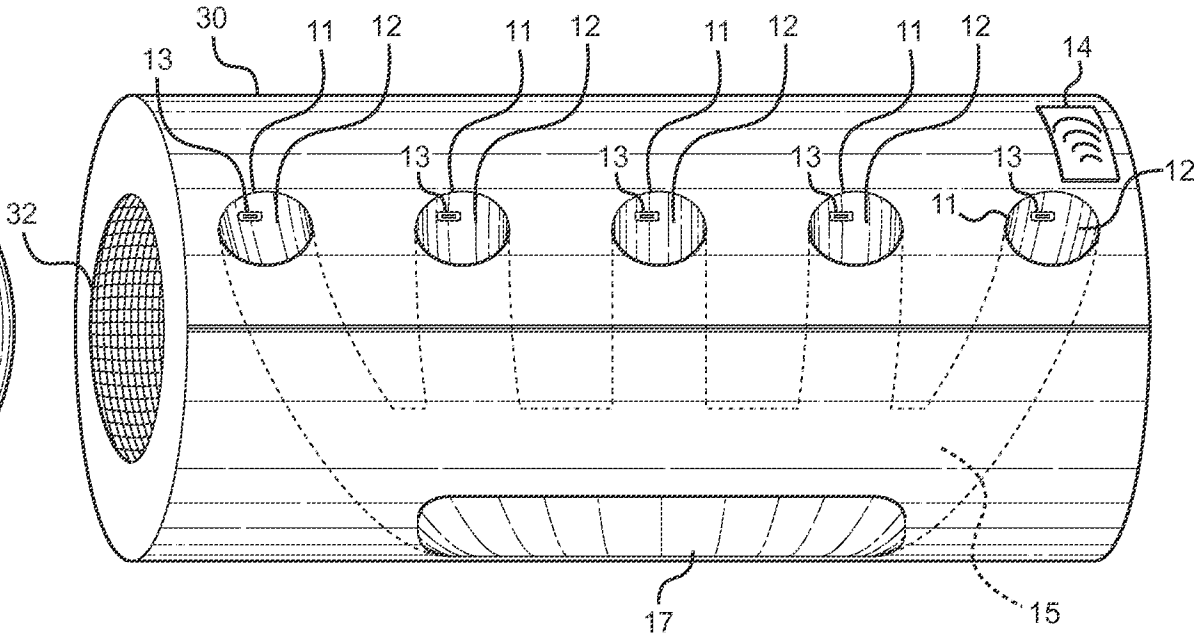
FIG. 3 shows a perspective view of an alternative embodiment of the projectile receptacle unit of the present invention.

Referring now to FIG. 3, there is a perspective view of an alternative embodiment of the receiving unit of the invention. There is a single housing 30 that comprises a plurality of receiving units, each receiving unit having an aperture 11, interior 12, and sensor 13. The sensors 13 are all operably connected to the transceiver 14. The transceiver 14 is configured to relay to a logic which aperture a projectile 20 has entered. In another embodiment of the invention, each sensor 13 is a radio frequency identification sensor that is configured to detect which projectile 20 has entered which aperture based on the radio identification tag 21 and relay that information to the transceiver 14.

There is a channel 15 within the housing 30 that is made up of multiple paths, each path leading to a unique interior. The paths converge to a common second opening 17 wherefrom the projectile 20 is ejected. Another embodiment of the invention comprises an audio speaker 32, which is operably connected to the logic and configured to play back audio from the logic, as relayed through the transceiver 14. For example, the speaker can play music that accompanies and enhances the gameplay experience. Additionally, the speaker can play audio that is streamed through the transceiver 14, such as audio from an internet source.

Figure 4B:
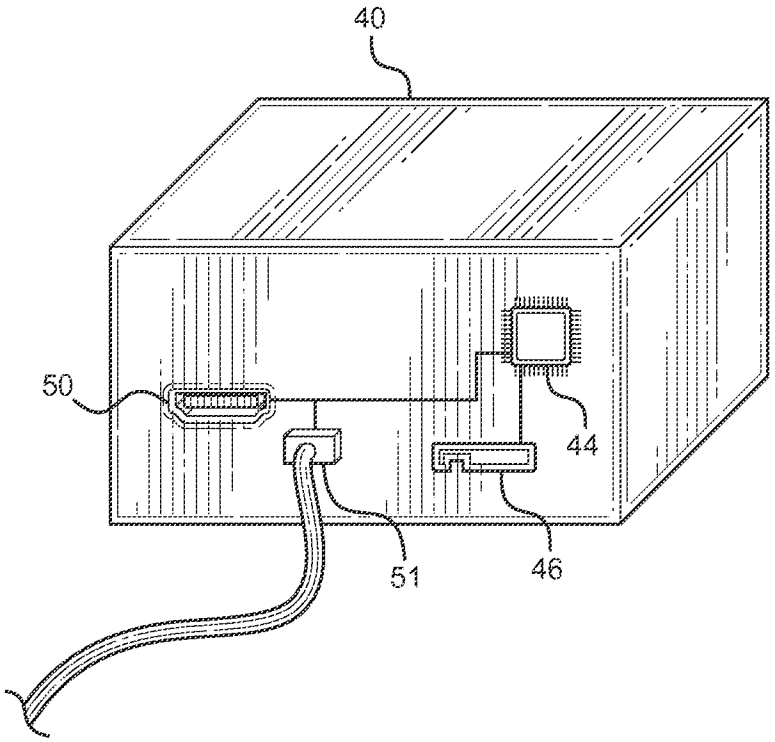
FIG. 4B shows a perspective view of an alternative embodiment of the logic of the present invention.
Figure 4A:
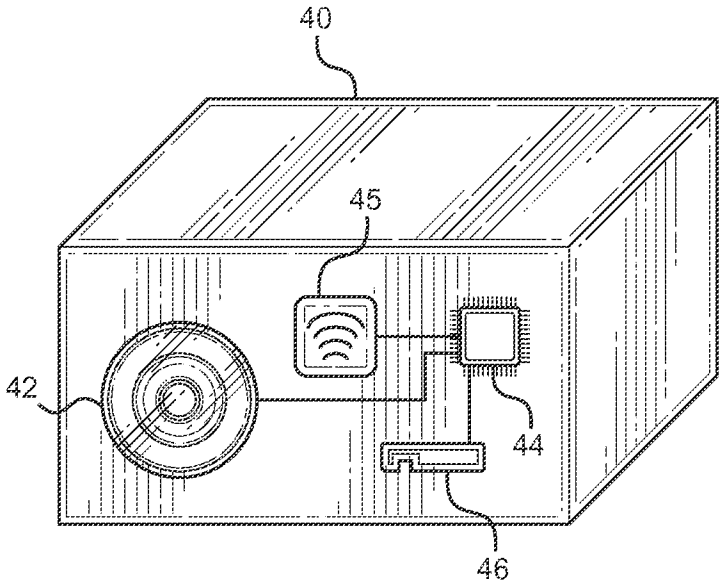
FIG. 4A shows a perspective view of an embodiment of the logic of the present invention.

Referring now to FIGS. 4A and 4B, there are shown perspective views of the logic unit of an embodiment of the invention. The logic unit comprises a housing 40, a logic 44 disposed in the housing, a transceiver 45 and a visual output. In one embodiment of the invention, the visual output is an image projector 42 that can display an image on a flat surface such as a wall or a projector screen. In another embodiment of the invention, the visual output is a port 50 configured to output an image signal to a device capable of receiving the image signal. For example, the port 50 can be a High-Definition Multimedia Interface (HDMI) port, which can be connected via an HDMI cable to a television monitor that is equipped with an HDMI input port. In yet another embodiment of the invention, the logic is operably connected to a physical port 51 and communicates with the receiving units through a wired connection as opposed to a wireless connection.

Figure 5:
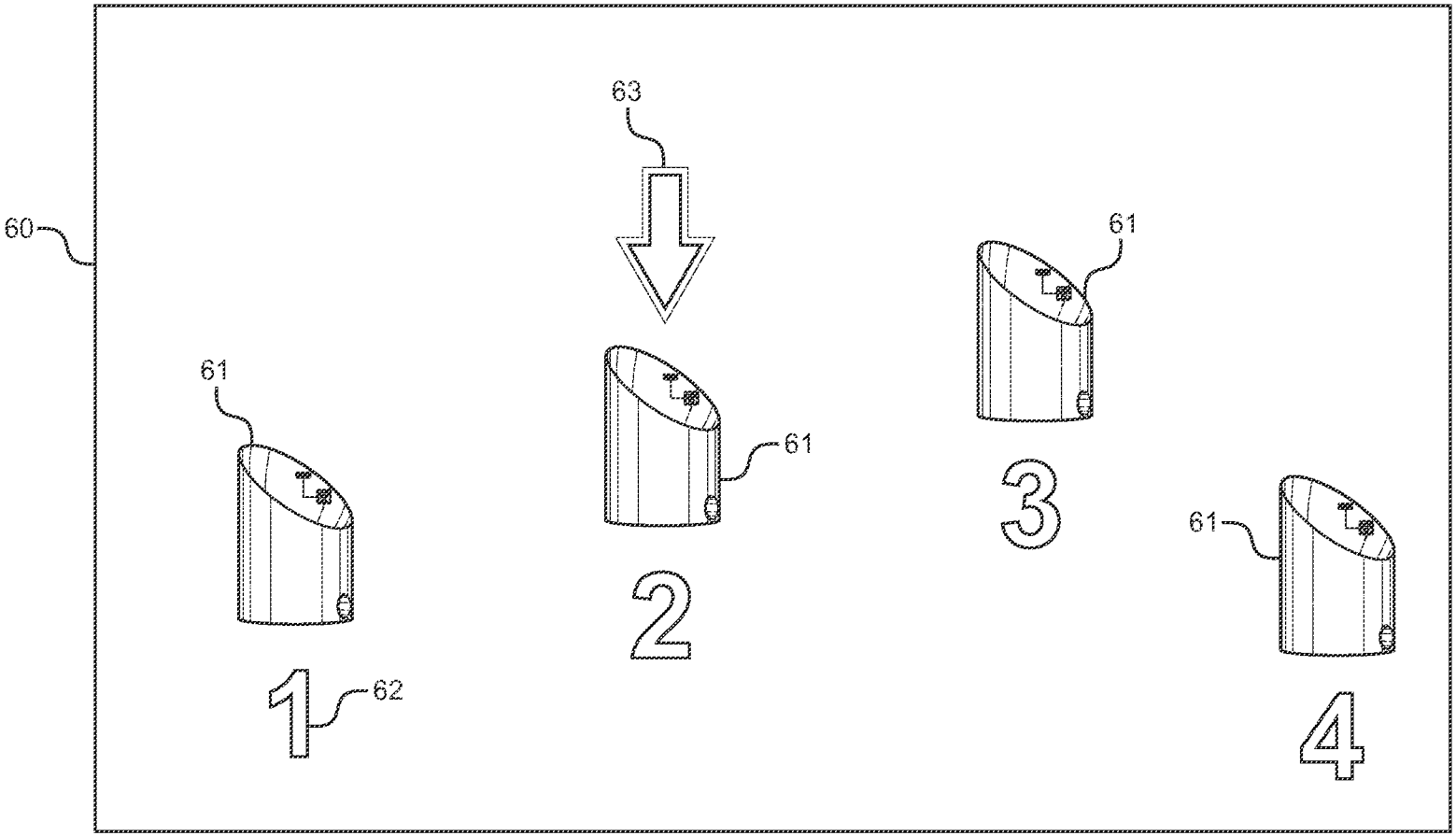
FIG. 5 shows a diagram view of an embodiment of the visual output of the invention.

Referring now to FIG. 5, there is shown a diagram of an embodiment of the visual output of the invention. There is a virtual image 60 that includes virtual versions of receiving units 61. Each receiving unit 61 is uniquely identified, such as through a numbering system 62. The virtual image 60 includes an indicium 63 indicating which receiving unit a projectile 20 must be thrown into. Furthermore, the virtual image 60 can indicate which projectile 20 must be used. For example, if there are projectiles 20 that are red, yellow and blue, the indicia 63 used to indicate which receiving unit to throw into can be red, indicating that only a red projectile can be used for that throw. If a user either throws a red projectile into another receiving unit, or throws a yellow or blue colored projectile in the correct receiving unit, the user is penalized.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A projectile receiving unit, comprising:

a housing having a sidewall defining an interior and an aperture providing access to the interior, the aperture configured to admit a projectile having a unique identifier;

a channel defined by a first opening and a second opening, the first opening disposed in the interior, the second opening disposed on the sidewall;

wherein the projectile is configured to pass entirely through the housing when received through the channel;

a sensor configured to detect when the projectile enters the interior;

a transceiver operably connected to the sensor, the transceiver configured to relay the unique identifier to a logic when the sensor detects the projectile entering the interior.

2. The projectile receiving unit of claim 1, wherein the sensor is a radio frequency sensor configured to identify a projectile that emits a specific radio frequency.

3. The projectile receiving unit of claim 2, further comprising a projectile that is equipped with a radio frequency transmitter.

4. The projectile receiving unit of claim 1, wherein the aperture is disposed on the housing at an inclined angle, such that a portion of the interior of the housing is exposed and configured to deflect incoming projectiles into the interior.

5. The projectile receiving unit of claim 1, further comprising a plurality of apertures disposed on the housing, wherein each of the plurality of apertures includes an interior and a sensor.

6. The projectile receiving unit of claim 5, further comprising a plurality of channels having a first opening that corresponds to each of the plurality of apertures and a second opening disposed on an exterior sidewall of the housing, such that the plurality of channels share the same second opening.

7. The projectile receiving unit of claim 1, wherein the sensor is an optical sensor.

8. The projectile receiving unit of claim 1, further comprising an audio speaker operably connected to the logic, the logic further configured to play back an audio recording through the audio speaker.

9. The projectile receiving unit of claim 1, wherein an interior surface of the sidewall is tapered from the aperture to the first opening of the channel.

10. A projectile receiving system comprising:

a projectile receiving unit, the projectile receiving unit comprising:

a housing having a sidewall defining an interior with an aperture providing access to the interior, the aperture configured to admit a projectile having a unique identifier;

a channel defined by a first opening and a second opening, the first opening disposed in the interior, the second opening disposed on the sidewall;

wherein the projectile is configured to pass entirely through the housing when received through the channel;

a sensor configured to detect when the projectile enters the interior of the housing;

a transceiver operably connected to the sensor, the transceiver configured to relay the unique identification of a received projectile to a logic;

a logic operably connected to the sensor, the logic connectable to a visual output, the logic outputting:

a receiving unit image, corresponding to the projectile receiving unit;

a projectile image, corresponding to a projectile;

an indicia designating an aperture of the receiving unit image;

wherein the logic displays when the projectile enters the aperture designated by the indicia.

11. The projectile receiving system of claim 10, wherein the sensor is a radio frequency sensor configured to identify a projectile that emits a specific radio frequency.

12. The projectile receiving system of claim 10, further comprising a projectile that is equipped with a radio frequency transmitter.

13. The projectile receiving system of claim 10, wherein the aperture is disposed on the housing at an inclined angle, such that a portion of the interior of the housing is exposed and configured to deflect incoming projectiles into the interior.

14. The projectile receiving system of claim 10, further comprising a plurality of apertures disposed on the housing, wherein there exists for each aperture a unique interior and sensor.

15. The projectile receiving system of claim 14, further comprising a plurality of channels having a first opening that corresponds to each of the plurality of apertures and a second opening disposed on an exterior sidewall of the housing, such that the plurality of channels share the same second opening.

16. The projectile receiving unit of claim 15, wherein the logic is further configured to stream an audio stream via the transceiver.

17. The projectile receiving system of claim 10, further comprising a logic housing and a video projector, wherein the logic is and the video projector are disposed within the logic housing.

18. The projectile receiving system of claim 10, further comprising a logic housing and a video output connection, wherein the logic is and the video output connection are disposed within the logic housing.

19. The projectile receiving system of claim 10, wherein the sensor is an optical sensor.

20. The projectile receiving system of claim 10, wherein an audio speaker is disposed on the housing and is operably connected to the logic, the logic further configured to play back an audio recording through the audio speaker.

* * * * *